United States Patent [19]

Napolitano

[11] Patent Number: 4,579,264

[45] Date of Patent: Apr. 1, 1986

[54] BABY CARRYING DEVICE

[76] Inventor: Nadine A. Napolitano, Milton Rd., Litchfield, Conn. 06759

[21] Appl. No.: 231,919

[22] Filed: Feb. 5, 1981

[51] Int. Cl.[4] ..... A47D 13/02

[52] U.S. Cl. ..... 224/160; 224/158

[58] Field of Search ..... 224/160, 158, 159, 155

[56] References Cited

U.S. PATENT DOCUMENTS

| | | | |
|---|---|---|---|
| 2,554,340 | 5/1951 | Maxwell | 224/16 |
| 2,652,183 | 9/1953 | Hlivka | 297/465 |
| 2,804,249 | 8/1957 | Manalo | 224/158 |
| 3,481,517 | 12/1969 | Aukerman | 224/160 |
| 3,841,543 | 10/1974 | Bolton | 224/158 |
| 4,009,808 | 3/1977 | Sharp | 224/160 |
| 4,037,764 | 7/1977 | Almosnino et al. | 224/160 |
| 4,139,131 | 2/1979 | Hathaway | 224/160 |

FOREIGN PATENT DOCUMENTS

| | | | |
|---|---|---|---|
| 540672 | 10/1941 | United Kingdom | 224/158 |

*Primary Examiner*—Steven M. Pollard

[57] ABSTRACT

A fabric baby carrier is secured to an adult by simple tie straps. The carrier includes an outer pouch and an inner pouch formed on the inner surface of front panel of the outer pouch. The upper edges of both inner and outer pouches are elasticized to permit the baby a degree of freedom of movement without sacrificing secure support. Furthermore, the inner pouch is flared in the rear adjacent the crotch to prevent the legs from swinging excessively and thereby injuring the child.

13 Claims, 15 Drawing Figures

BABY CARRYING DEVICE

BACKGROUND OF THE INVENTION

The present invention is related to baby carriers of the fabric type that leave the hands of the adult free while the baby is being carried.

Carriers that permit babies to travel with adults but leave the adult's hands free are not new; they appear to have been used by stone-age cultures. However, such carriers have enjoyed renewed popularity in recent years as the enhanced mobility that they afford parents of young children has again been recognized. The convenience of these carriers has permitted parents to carry children for longer periods and engage in activities that are more strenuous than would have been permitted without the use of the baby carrier.

Naturally, a large number of designs have been produced to meet the resultant demand, and most have been designed with a concern both for the safety of the child and the comfort of the parent. However, the comfort of the child does not appear to have ordinarily been a primary design criterion for many baby carriers presently available, and the concern for safety has often resulted in designs that excessively restrict the child's freedom of movement so that he does not travel contentedly for very long. Furthermore, many designs, although providing safety in the sense that the child is unlikely to fall out of the carrier, permit uncontrolled motion of the legs during strenuous parental activity, and orthopedic problems at the hips have sometimes resulted.

It is accordingly an object of the present invention to permit some freedom of movement and thus comfort for the baby while preventing excessive movement of the legs.

SUMMARY OF THE INVENTION

The foregoing and related objects are achieved in a baby carrier that includes a flexible pouch having upper and lower ends and including first and second fabric panel portions joined near their upper ends to hold them in generally opposed orientation but leave an upper opening in the pouch. The panel portions meet at the lower end of the pouch to provide a generally closed lower end. At least a portion of the upper edge of the second fabric panel is resiliently expandable for flexible retention of a baby carried in the pouch. A fabric seat member is secured to the inner surface of the first panel portion to form therewith an inner seat pouch. The seat member has a first end portion secured to the inner surface of the first panel and vertically extending toward the lower end of the flexible pouch defined by the first and second panel members and then extending away from it to provide a pocket of generally J-shaped cross section. The other end of the seat member is secured along its side margins to the inner surface of the first panel at points spaced towards the upper end of the first panel from the point of attachment of the first end of the seat member. In combination with the first panel portion, it provides the inner seat pouch. The bottom of the seat pouch provides a crotch portion.

The seat member has an unsecured upper end between its marginal points of attachment that provides a waist opening. It also has unsecured side portions providing leg openings between the crotch portion and the marginal points of attachment. The waist and leg openings are sized to receive the waist and legs, respectively, of a baby supported in the inner seat pouch. At least a portion of the upper edge of the fabric seat portion is resiliently expandable at the waist opening for flexible support of a baby supported in the inner pouch. The rear portion of the inner seat pouch has a flared portion wider than the waist opening in its expanded condition to extend along part of the legs of the baby supported in the inner seat pouch and inhibit rearward motion of the baby's legs. Straps are provided on the first panel portion that are sized to fit around the shoulders of an adult and are adapted to be tied when disposed about the shoulders of the adult to secure the carrier to the adult.

The baby carrier can include resiliently expandable attachment means attaching the sides of the first and second panel members together intermediate their upper and lower ends to hold the panel members together but accommodate limited movement of the baby carried in the flexible pouch. The resilient attachment means could include a resiliently expandable loop provided on each side margin of the second panel member intermediate its upper and lower ends. There would also be included means on the first panel for extending through the resiliently expandable loops on the second panel and holding them to the first panel. The means on the first panel for holding the resiliently expandable loops to the first panel could conveniently be loops extending from the side margins of the first panel and sized to extend through the resiliently expandable loops on the second panel. The straps on the first panel would be sized to fit around the shoulders of an adult, extend through the loops on the first panel while they extend through the loops on the second panel, and be tied in place. Tying of the straps would thereby hold the loops on the second panel to the loops on the first panel.

In the illustrated embodiment, a plurality of loops is provided on each of the side margins of the first panel member, the loops being vertically spaced for adjustment of the fit of the baby carrier on an adult by changing the loop through which the straps extend.

It may be found desirable to include a fabric head-support member of generally rectangular configuration with upper and lower sides extending between opposite ends and having the side marginal portions folded toward each other at their ends thereof to form longitudinal folds. The head-support member is stitched at its end portions to hold the ends of the side marginal portions in their folded positions. The side marginal portions of the head-support member are free intermediate their ends to permit formation of a cup-shaped support by the head-support member. At least one end portion of the head-support member could be folded upon itself to provide a transverse fold substantially parallel to the longitudinal folds. The transverse fold should be held in place by stitching that is removable to release the transverse fold and thereby increase the effective length of the head-support member.

The shoulder straps of the illustrated embodiment include shoulder-pad portions positioned to be disposed at the shoulders of an adult carrying the baby carrier.

Each of the shoulder pads includes a closed elongated fabric sleeve and padding material contained in the sleeve. The fabric sleeve is sewn on the bias to provide a comfortable fit. The shoulder pad further includes a fabric insert sewn interior to the pocket of the shoulder pad and extending longitudinally between its ends. The grain of the insert extends longitudinally of the strap to inhibit longitudinal stretching of the sleeve.

With or without the resiliently expandable upper edges on the seat pouch and the second fabric portion, the baby carrier can include a waist strap attached to the lower end of the flexible pouch and sized to fit around the waist of an adult carrying the pouch and to be tied at its free ends to help secure the baby carrier to the adult.

A particularly comfortable baby carrier is provided if the first panel portion is sized to fit against the chest of an adult supporting the pouch and is reduced in horizontal dimension near its upper end at the position of the shoulders of the adult.

BRIEF DESCRIPTION OF THE DRAWINGS

These and further features and advantages of the present invention are described in connection with the accompanying drawings, in which.

DETAILED DESCRIPTION OF THE PREFERRED EMBODIMENT

Figure 1:
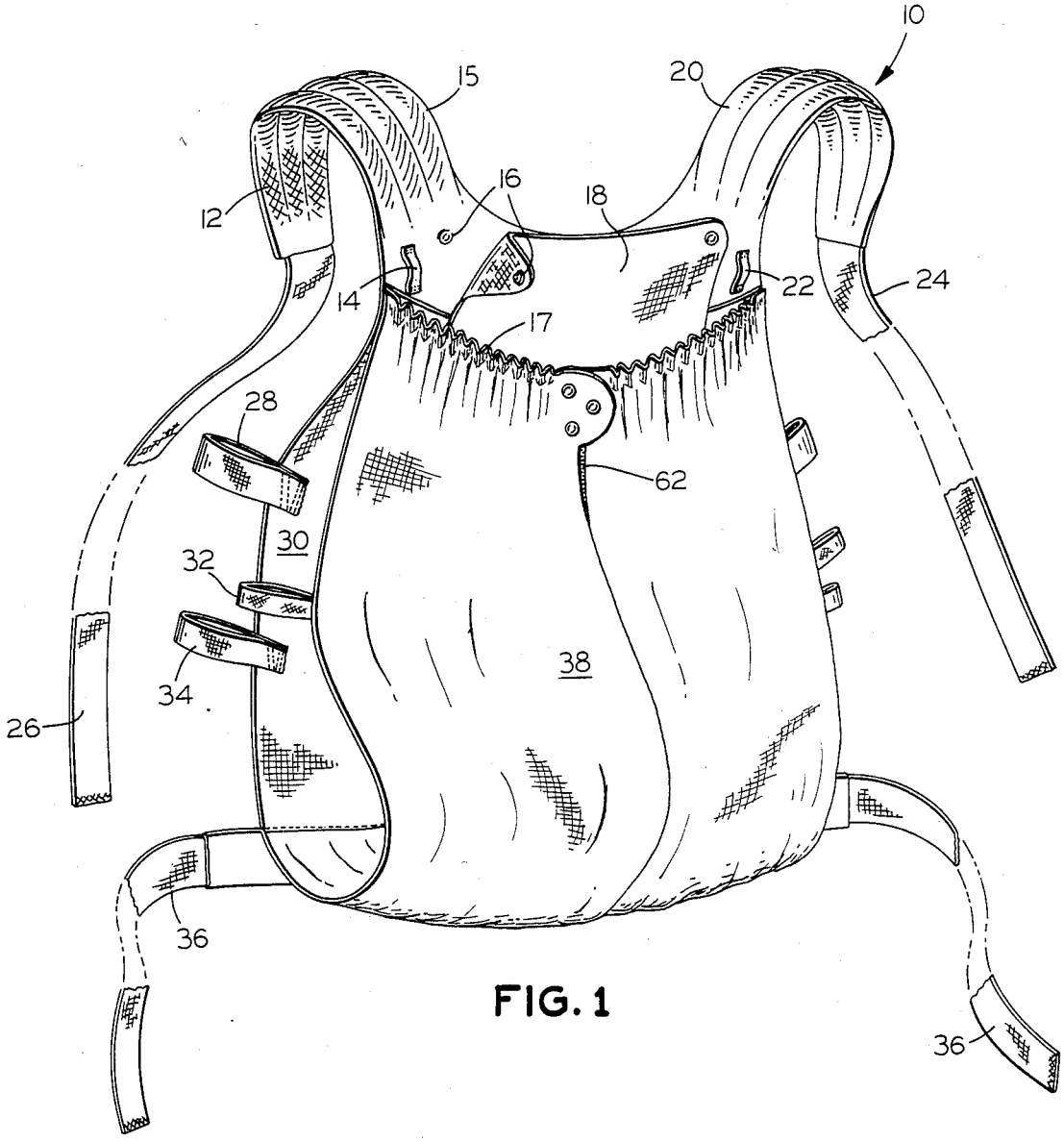
FIG. 1 is a perspective view of the baby carrier of the present invention without the head support attached.
Figure 3:
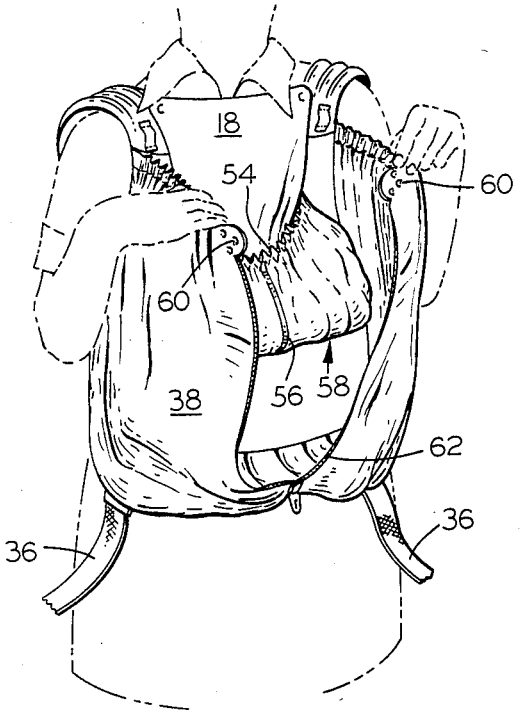
FIG. 3 is a perspective view of the baby carrier of FIG. 1 with the zipper on the back panel open to show the inner seat pouch.
Figure 7:
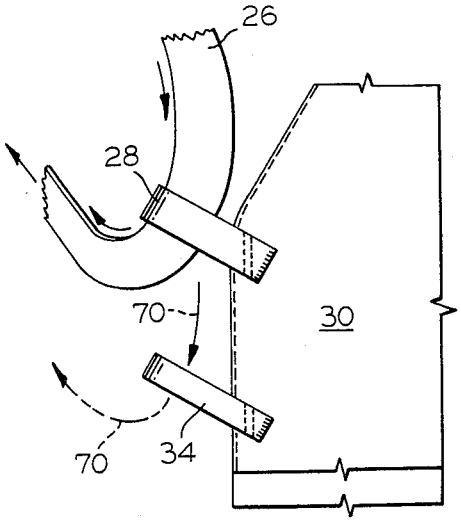
FIG. 7 is a simplified view of an edge portion of the front panel of the outer pouch illustrating a strap extending through one of its loops.
Figure 13:
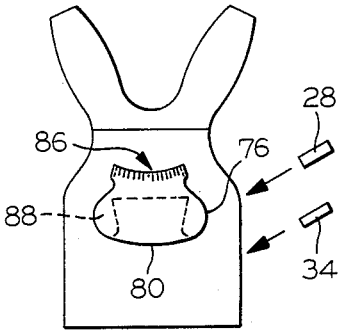
FIG. 13 is a view similar to that of FIG. 12 with the fabric piece sewn at the top.

The drawings illustrate a fabric baby carrier shown in perspective in FIG. 1 that is provided with tie straps 24, 26, and 36 that are tied to support a child on an adult. The carrier includes an outer pouch made of front and rear panel portions 30 and 38, respectively, the upper edge 17 of the rear panel being gathered and provided with an elastic insert. As FIG. 3 illustrates, an inner seat pouch 58 is also provided for supporting the child. The seat pouch is seen in FIG. 13 to be flared in the back near the crotch to support the baby's legs and prevent them from swinging backward. Its upper edge is also elasticized. The straps extend through one or the other of loops 28 and 34 on the side of the pouch, as FIG. 7 shows, to hold the panels together.

The fabric baby carrier 10 of FIG. 1 includes an outer pouch having a front panel 30 with straps that include elongated shoulder pads 15 and 20 extending from its left and right upper corners, respectively. Pad 15 includes an outer fabric sleeve 12 that is sewn on the bias to permit some stretching. Padding material (not shown) is included inside sleeve 12. Straps 26 and 24 continue beyond the ends of shoulder pads 15 and 20, respectively, and extend through side loops when the carrier is in use. The free ends of straps 24 and 26 are tied to secure the baby carrier to the adult. A further strap 36 is provided at the lower edge of front panel 30. Strap 36 extends around the waist of the adult when the carrier is in use, and its free ends are tied together for further support.

A rear panel portion 38 of the pouch joins front panel 30 at its lower end and is provided with a gathered and elasticized upper edge 17 to permit some freedom of movement of the child inside. From each side margin of the rear panel 38 extends an elastic loop 32. Further loops 28 and 34 extend from the edge margin of front panel 30. Loops 28 and 34 would typically be made of the same material as the panels are. Any suitable material, such as cotton, could be used for the panels.

A "bib" 18 is disposed between panels 30 and 38 and is held to rear panel 30 by snaps 16 or other suitable fasteners. Adjacent either end of the bib are further loops 14 and 22 secured near the upper corners of front panel 30. These are used when the head support illustrated in FIG. 2 is to be tied to the baby carrier.

Figure 2:
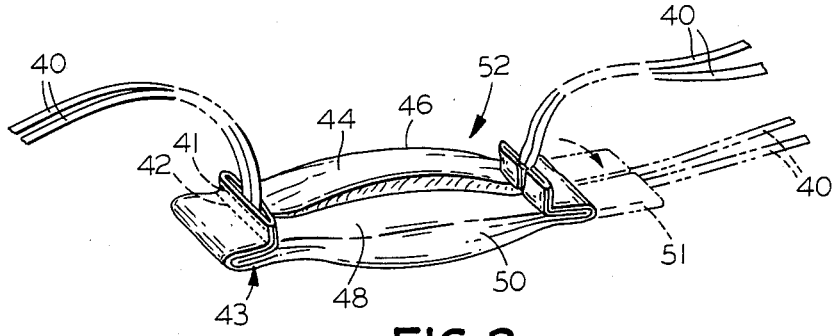
FIG. 2 is a perspective view of the head support.

As FIG. 2 illustrates, the head support largely comprises a generally rectangular sheet of fabric provided with longitudinal folds 50 and 46 spaced from the longitudinally extending edges of the fabric. Stitching 42 extending transversely to the longitudinally extending edges is provided on the end portions to maintain the folds in the end portions but permit the side marginal portions extending between the end portions to open and form a cup-shaped support for the baby's head. Straps 40, made of ribbons, for instance, are attached to both ends of the head support, and these straps 40 can be tied through loops 14 and 22 to secure the head support into position on the baby carrier.

Rear panel 38 is provided with a zipper 62, as shown in FIG. 3, that extends vertically up the center of rear panel 38. Also shown in FIG. 3 are snaps disposed at the upper end of the zipper opening. By unfastening the snaps and unzipping rear panel 38, access is afforded to the interior of the outer pouch, where an inner seat pouch 58 is provided.

Figure 4:
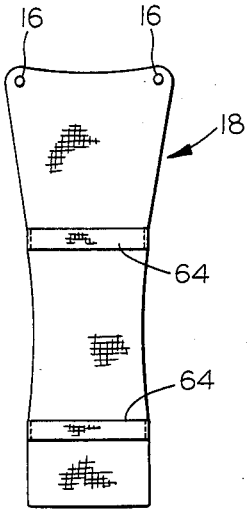
FIG. 4 is a plan view of the bib detached from the baby carrier.

Like the outer pouch, the upper edge of the rear of inner pouch 58 is elasticized and gathered. Also like the outer pouch, inner pouch 58 includes a zipper 56 that extends vertically and permits the inner pouch to be opened. Inside the inner pouch, a diaper is usually provided. For this purpose, a "bib" 18 extends from near the upper edge of front panel 30 down into the interior of the inner pouch. As can be seen in FIG. 4, bib 18 includes two transverse straps 64 that, together with the body of the bib, provide loops through which a diaper can extend. Thus, the diaper of a baby carried in the inner seat pouch can be changed by opening zipper 56, removing bib 18 with the diaper held in its loops, and replacing it with a new bib having a new diaper. The baby carrier is ordinarily sold with substitute bibs.

Figure 5:
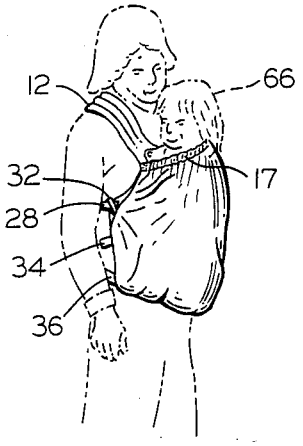
FIG. 5 is a perspective view showing the baby carrier mounted on the chest of an adult and containing a relatively small child.
Figure 6:
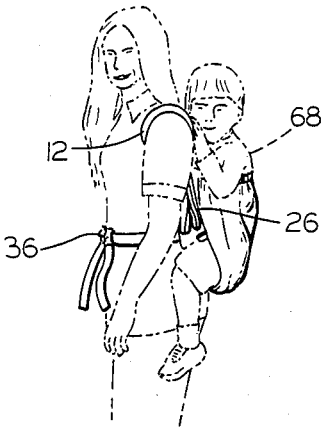
FIG. 6 is a perspective view of the baby carrier mounted on the back of an adult and carrying a somewhat bigger child.
Figure 8:
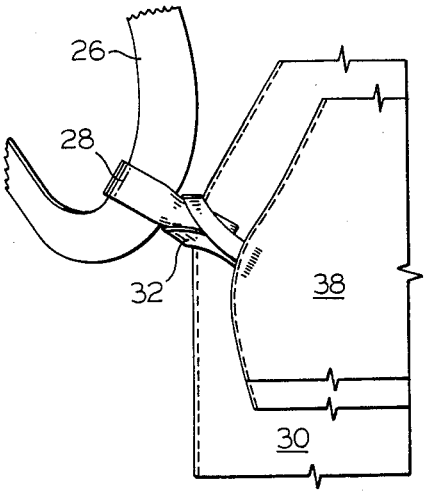
FIG. 8 is a view similar to FIG. 7 with the loop on the rear panel of the outer pouch being held by a loop on the front panel.

Two typical positions for the baby carrier are shown in FIGS. 5 and 6, and the arrangement of the straps and loops to achieve these positions are illustrated in FIGS. 7 and 8. As FIG. 5 shows, it is possible to hold the child on the chest of the adult. The recommended way to secure the baby carrier to the adult is to run one of the straps 24 and 25 over one shoulder and down through a loop 28 or 34 on the side opposite the shoulder. This is done for both straps 24 and 25 and results in a criss-cross arrangement of the straps in the back. As FIG. 7 shows, a strap can extend through either loop 28 or loop 34. The choice depends largely on the size of the adult; larger adults will find the use of loop 34 to be more comfortable, while adults of smaller stature would ordinarily be more comfortable using loop 28. After the straps have been led through their respective loops, the free ends are tied together. The process is completed by tying the free ends of waist strap 36 behind the adult.

It may be desired, particularly in cooler weather, to hold the rear pouch relatively closer to the front pouch in order to shield the child from the wind. This is achieved by training loop 28 or 38, whichever one the strap is to extend through, through elastic loop 32. This holds the back panel 38 closed, but elastic loop 32 still permits the baby some freedom of movement inside the pouch.

FIG. 6 shows an alternate position for the baby carrier, in which the child is carried on the adult's back. In this case, the shoulder pad 12 again extends over the shoulder of the adult, but the strap, instead of extending across the adult's body, is trained through a loop on the same side of the baby carrier as the associated shoulder pad. Accordingly, rather than having the free ends of straps 24 and 26 tied together, each is tied to the associated loop. For further comfort, an extra strap, (not shown) can be tied between straps 24 and 26. Waist strap 36 is again tied together at its free ends to secure the baby carrier to the adult.

It will be noted that this baby carrier is attached to the adult merely by tying the various straps; no hard metal fasteners are required. It has been found that this arrangement is very convenient in that it provides a maximum of adjustability and comfort while minimizing the number of hard objects that can come into contact with the child.

Figure 9:
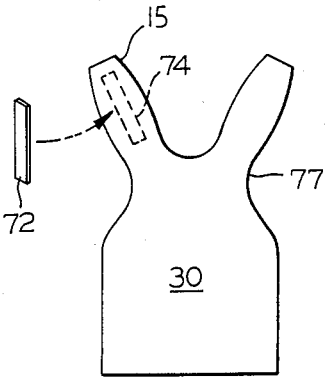
FIG. 9 is a simplified representation of the front panel showing the position of a fabric insert.

It was noted in connection with FIG. 1 that the shoulder straps 15 and 20 include padding material enclosed in an outer sleeve 12 made of fabric sewn on the bias so that the pad can stretch to conform to the shoulder of the wearer. However, it is not desirable for all of the stretching to occur in the longitudinal direction, so an insert is employed to prevent excessive longitudinal stretching. This is illustrated in FIG. 9, in which it is seen that an insert 72, typically of the same material as that used in sleeve 12, is sewn inside the shoulder pad in a position suggested by dashed lines 74. Rather than being sewn on the bias, insert 72 is shown with its threads extending longitudinally so that less stretching is permitted in the longitudinal direction. It has been found that restriction of longitudinal stretching while permitting stretching in the transverse direction provides a particularly comfortable fit of the shoulder pad.

According to the present invention, the inner pouch 58 is designed so as to inhibit some rearward motion of the child's legs. In some other baby carriers in which an inner pouch is provided, it has been found that an excessive amount of stress must be borne at the baby's crotch and that the baby's legs are typically permitted to swing backward when the adult engages in strenuous activities. As is suggested in FIG. 19 and described in more detail by reference to FIGS. 11–13, however, the inner seat pouch illustrated in the drawings provides support for the baby's legs to prevent them from flailing about as the result of the motion of the parent. The inner pouch provides a flared portion 76 on the rear of the pouch that extends laterally behind the legs of the child so as to somewhat restrict the rearward motion of the leg and distribute the weight of the child.

Figure 12:
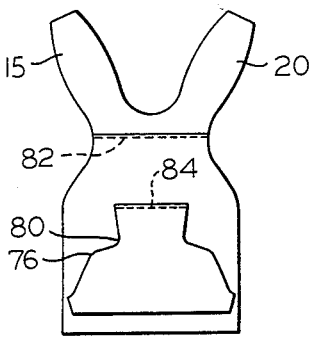
FIG. 12 shows the piece of FIG. 11 with its lower edge sewn to the front panel of the outer pouch.
Figure 11:
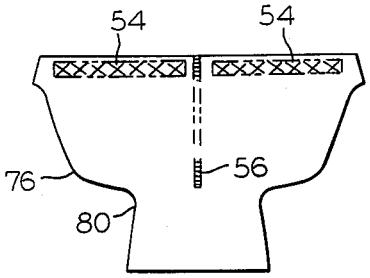
FIG. 11 shows a fabric piece that is used in providing the inner seat pouch.
Figure 10:
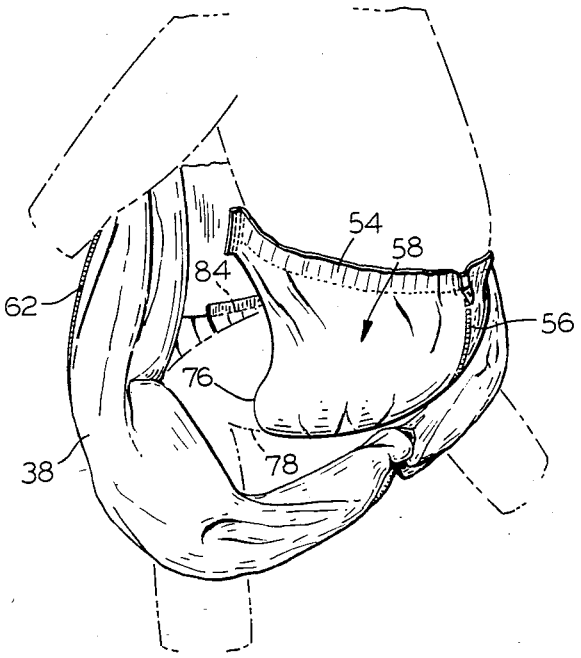
FIG. 10 is a perspective view with the rear panel open to show the inner seat pouch in which a baby is supported.

This can be seen to an extent in FIG. 10, but it is demonstrated more clearly in FIGS. 11–13. FIG. 11 shows a seat member that, together with front panel 30, forms the inner seat pouch. Before the seat member is sewn in place, it includes a somewhat narrowed portion 80 at the bottom, the upper end of which will provide the crotch of the inner seat. This widens into a flared portion 76 that is the widest portion of the seat when it is sewn in place but is somewhat narrower than the waist before the upper edge is gathered. A sleeve 54 in the upper edge contains elastic material that permits resilient expansion when the upper edge has been gathered.

The lower edge of the seat member is first sewn in place at its lower edge by stitching 84, as FIG. 12 illustrates. FIG. 12 also shows that the shoulder straps 15 and 20 will typically be sewn on the front panel, as stitching 82 suggests, but they could, of course be provided as a piece integral with the front panel.

After the lower end of the seat member has been sewn into place, the waist portion of the seat member is gathered with the elastic sewn in, and the side marginal portions of the upper end are then sewn to the front panel. By sewing the ends of the waist portion to the front panel, a waist opening 86 is defined between the points of attachment. These marginal points of attachment, together with crotch portion 80, also define leg openings 88 through which the child's legs extend. This results in the arrangement of FIG. 13, in which flared portion 76 extends outward farther than the width of the waist. Although the relative dimensions of the flared and waist portions need not be exactly as shown, flared portion 76 should be wider than the waist even when the waist is expanded by the presence of the child. Due to the flaring of the back portion of the inner seat adjacent the crotch, the hip joints of the child are spaced significantly from the edges of flared portion 76 so that the backs of the child's legs are supported and prevented from swinging backward very far.

Figure 14:
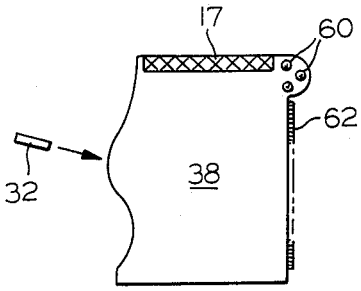
FIG. 14 illustrates the pattern of the rear panel of the outer pouch.

The patterns of front panel 30 and rear panel 38 can be seen in FIGS. 9 and 14, respectively. Part of the comfort experienced by wearers of this baby carrier is due to indentations 77 provided in its edges at the position of the shoulder of the adult. Front panel 30 is more like a panel in a shirt than one in a pack, and it is thought that this contributes significantly to the comfort enjoyed by the adult. Further advantages also flow from this design; users of this type of baby carrier have found that it is possible for the mother to breast feed the child without removing him from the carrier.

One half of rear panel 38 is shown in FIG. 14, where it is seen that elastic loop 32 is positioned at a bulge in the side edge of the panel. Experience has taught that this design prevents the child from being excessively confined when loops 32 are used.

Figure 15:
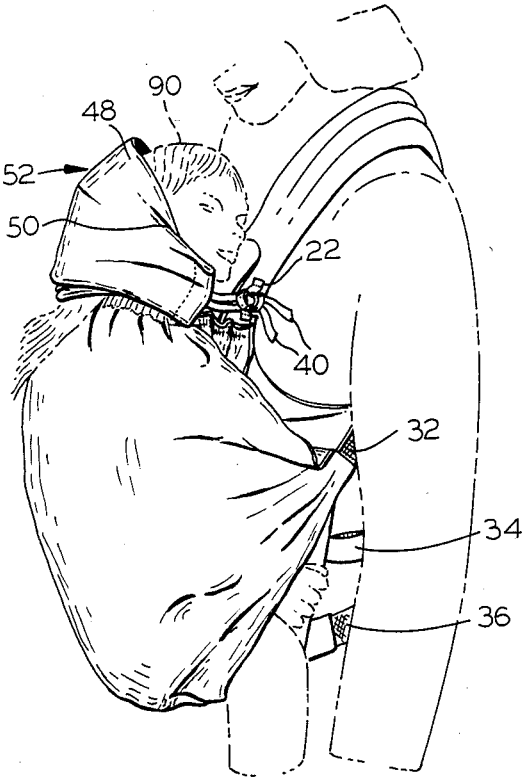
FIG. 15 is a perspective view of the baby carrier showing the head support tied in place.

When sleeping or very young children are to be carried, head support 52 can be employed, as FIG. 15 illustrates. The tie straps 40 on the ends of the head support are tied to loops 4 and 22 at the upper corners of the front panel, and the head 0 of a small child can thereby be supported.

Simultaneous reference to FIGS. 2 and 14 reveals that head support 52 can adopt a cup-like configuration. Although the side marginal portions 48 and 44 are shown in FIG. 2 as lying against the central portion of the head support, it can be seen in FIG. 15 that the curving of head support 52 against head 90 of the infant permits the side marginal portions 44 and 48 to fold outward to cup the head of the infant and afford a comfortable support.

As the baby grows, it becomes desirable for the head support to be increased in size. This is achieved with head support 52 of FIG. 2 by removing stitching 42. Removal of stitching 42 does not permit folds 46 and 48 to come free at the left end of the head support, because stitching 41 remains to keep the folds in place. However, removal of stitching 42 would allow a transverse fold 43 on the left end to be removed to lengthen the head support so that a larger head can be accommodated.

Further growth of the child can be accommodated by removing similar stitching at the other end of the head support, as phantom 51 suggests. Of course, a greater amount of adjustability could be afforded by providing more stitching at both ends.

It will be apparent from the foregoing description that a particularly advantageous baby carrier has been described. The carrier is secured it to the adult by simple tying of straps that include soft shoulder straps. Long use with considerable comfort is thereby permitted. The comfort of the adult is further enhanced by the shaping of the front panel to accommodate his shoulders. The comfort of the child is also increased because a high degree of freedom is afforded. The upper edges of the rear panels of the outer and inner pouches are elasticized, as is the loop for holding the rear panel to the front panel, so the child is less confined and remains content longer. Despite this increased freedom of movement, orthopedic problems that can arise from excessive flailing about of the child's legs are avoided by the flared construction of the seat pouch. Thus, this baby carrier constitutes a significant advance in the art.

Having thus described the invention, I claim:

1. A baby carrier comprising:

a. a flexible pouch having upper and lower ends and including first and second fabric panel portions joined near their upper ends to hold them in generally opposed orientation but leave an upper opening in said pouch, said panel portions meeting at the lower end of said pouch to provide a generally closed lower end, at least a portion of the upper edge of said second fabric panel being resiliently expandable for flexible retention of a baby carried in said pouch;

b. a fabric seat member secured to the inner surface of said first panel portion to form therewith an inner seat pouch, said seat member having first and second end portions and an intermediate portion therebetween, said first end portion having its end spaced from said intermediate portion secured to said inner surface of said first panel and vertically extending therefrom toward the lower end of said flexible pouch defined by said first and second panel members, said intermediate portion extending away from the lower end of said first end portion and said second end portion extending upwardly from said intermediate portion and having its upper end secured along its side margins to said inner surface of said first panel at points spaced towards said upper end of said first panel from the point of attachment of said end of said first end portion of said seat member to provide, in combination with said first panel portion, said inner seat pouch, the bottom of said seat pouch providing a crotch portion defined by the lower part of said first end portion and at least the adjacent part of said intermediate portion, the upper end of said second end portion of said seat member being unsecured to said flexible pouch between its marginal points of attachment and thereby providing a waist opening, said crotch portion and second end portion of said seat member also being unsecured along the side margins thereof to provide leg openings between said crotch portion and said marginal points of attachment, said waist and leg openings being sized to receive the waist and legs, respectively, of a baby supported in said inner seat pouch, at least a portion of the upper edge of said fabric seat portion being resiliently expandable at said waist opening for flexible support of a baby supported in said inner pouch, said second end portion of said inner seat pouch being of substantially greater width than said crotch portion and than the spacing between the points of attachment of its upper end to said first panel to provide a flared seat portion wider than said waist opening in its expanded condition to extend along part of the legs of the baby supported in said inner seat pouch and inhibit rearward motion of the baby's legs; and c. straps on said first panel portion sized to fit around the shoulders of an adult and adapted to be tied when disposed about the shoulders of the adult to secure said carrier to the adult.

2. A baby carrier comprising:

a. a flexible pouch having upper and lower ends and including first and second fabric panel portions joined near their upper ends to hold them in generally opposed orientation but leave an upper opening in said pouch, said panel portions meeting at the lower end of said pouch to provide a generally closed lower end, at least a portion of the upper edge of said second fabric panel being resiliently expandable for flexible retention of a baby carried in said pouch, resiliently expandable attachment means attaching the sides of said first and second panel members together intermediate said upper and lower ends thereof to hold said panel members together but accommodate limited movement of the baby carried in said flexible pouch;

b. a fabric seat member secured to the inner surface of said first panel portion to form therewith an inner seat pouch, said seat member having a first end portion secured to said inner surface of said first panel and vertically extending toward the lower end of said flexible pouch defined by said first and second panel members and then extending away therefrom to provide a pocket of generally J-shaped cross section, the other end of said seat member being secured along its side margins to said inner surface of said first panel at points spaced towards said upper end of said first panel from the point of attachment of said first end of said seat member to provide, in combination with said first panel portion, said inner seat pouch, the bottom of said seat pouch providing a crotch portion, said seat member having an unsecured upper end thereof between its marginal points of attachment providing a waist opening, said seat member also having unsecured side portions providing leg openings between said crotch portion and said marginal points of attachment, said waist and leg openings being sized to receive the waist and legs, respectively, of a baby supported in said inner seat pouch, at least a portion of the upper edge of said fabric seat portion being resiliently expandable at said waist opening for flexible support of a baby supported in said inner pouch, said rear portion of said inner seat pouch having a flared portion wider than said waist opening in its expanded condition to extend along part of the legs of the baby supported in said inner seat pouch and inhibit rearward motion of the baby's legs; and c. straps on said first panel portion sized to fit around the shoulders of an adult and adapted to be tied when disposed about the shoulders of the adult to secure said carrier to the adult.

3. The baby carrier of claim 2 wherein said resilient attachment means includes a resiliently expandable loop provided on each side margin of said second panel member intermediate its upper and lower ends, said baby carrier further including means on said first panel for extending through said resiliently expandable loops on said second panel and holding said loops to said first panel.

4. The baby carrier of claim 3 wherein said means on said first panel for holding said resiliently expandable loops to said first panel include loops extending from the side margins of said first panel and sized to extend through said resiliently expandable loops on said second panel, said straps on said first panel being sized to fit around the shoulders of an adult, extend through said loops on said first panel while said loops on said first panel extend through said loops on said second panel, and be tied in place, tying of said straps thereby holding said loops on said second panel to said loops on said first panel.

5. The baby carrier of claim 1 further including loops on the side margins of said first panel member, said straps being sized to extend over the shoulders of an adult carrying the baby carrier, extend through said loops on said first panel, and be tied to hold said straps in said loops.

6. The baby carrier of claim 5 wherein a plurality of loops is provided on each of said side margins of said first panel member, said loops being vertically spaced for adjustment of the fit of said baby carrier on an adult by changing the loop through which said straps extend.

7. The baby carrier of claim 1 further including a fabric head-support member of generally rectangular configuration with upper and lower sides extending between opposite ends and having the side marginal portions thereof folded toward each other at the ends thereof to form longitudinal folds, said head-support member being stitched at the end portions thereof to hold the ends of said side marginal portions in their folded positions, said side marginal portions of said head-support member being free intermediate the ends thereof to permit formation of a cup-shaped support by said head-support member.

8. The baby carrier of claim 7 wherein at least one end portion of said head-support member is folded upon itself to provide a transverse fold substantially parallel to said longitudinal folds, said transverse fold being held in place by stitching that is removable to release said transverse fold and thereby increase the effective length of said head-support member.

9. The baby carrier of claim 1 wherein said shoulder straps include shoulder-pad portions positioned thereon to be disposed at the shoulders of an adult carrying said baby carrier.

10. The baby carrier of claim 9 wherein each of said shoulder pads includes a closed elongated fabric sleeve and padding material contained in said sleeve, said fabric sleeve being sewn on the bias to provide a comfortable fit, said shoulder pad further including a fabric insert sewn interior to said pocket of said shoulder pad and extending longitudinally between the ends thereof, the grain of said insert extending longitudinally of said strap to inhibit longitudinal stretching of said sleeve.

11. A baby carrier comprising:

a. a flexible pouch having upper and lower ends and including first and second fabric panel portions joined near their upper ends to hold them in generally opposed orientation but leave an upper opening in said pouch, said panel portions meeting at the lower end of said pouch to provide a generally closed lower end;

b. a fabric seat member secured to the inner surface of said first panel portion to form therewith an inner seat pouch, said seat member having first and second end portions and an intermediate portion therebetween, said first end portion having its end spaced from said intermediate portion secured to said inner surface of said first panel portion and extending vertically therefrom towards the lower end of said flexible pouch defined by said first and second panel members, said intermediate portion extending away from the lower end of said first end portion and said second end portion extending upwardly from said intermediate portion and having its upper end secured along its side margin to said inner surface of said first panel at points spaced towards said upper end of said first panel from the point of attachment of said end of said first end portion of said seat member to provide, in combination with said first panel, said inner seat pouch, the bottom of said seat pouch providing a crotch portion defined by the lower part of said first end portion and at least the adjacent part of said intermediate portion, the upper end of said second end portion of said seat member being unsecured to said flexible pouch between the marginal points of attachment and thereby providing a waist opening, said crotch portion and second end portion of said seat member also being unsecured along the side margins thereof to provide leg openings between said crotch portion and said marginal points of attachment, said waist and leg openings being sized to receive the waist and legs, respectively, of a baby supported in said inner seat pouch, said second end portion of said inner seat pouch being of substantially greater width than said crotch portion and than the spacing between the points of attachment of its upper end to said first panel to provide a flared seat portion wider than said waist opening to extend along part of the legs of the baby supported in said inner seat pouch and inhibit rearward motion of the baby's legs;

c. straps extending from said upper end of said first panel portion, sized to fit around the shoulders of an adult, and adapted to be tied when disposed around the shoulders to secure said carrier to the adult; and d. a waist strap attached to the lower end of said flexible pouch and sized to fit around the waist of an adult carrying said pouch and to be tied at its free ends to help secure said baby carrier to the adult.

12. The baby carrier of claim 11 wherein at least a portion of the upper edge of said fabric seat portion is resiliently expandable at said waist opening for flexible support of the baby supported in said inner seat pouch.

13. The baby carrier of claim 11 wherein said first panel portion is sized to fit against the chest of an adult supporting said pouch, said first panel portion being reduced in horizontal dimension near its upper end at the position of the shoulders of the adult.

* * * * *